United States Patent [19]

Paine

[11] Patent Number: 4,653,405

[45] Date of Patent: Mar. 31, 1987

[54] SELF-DESTRUCTING PROJECTILE

[75] Inventor: Joseph P. Paine, Baltimore, Md.

[73] Assignee: Duchossois Industries, Inc., Elmhurst, Ill.

[21] Appl. No.: 780,946

[22] Filed: Sep. 27, 1985

[51] Int. Cl.[4] ..... F42B 13/205; F42B 8/00
[52] U.S. Cl. ..... 102/529; 244/3.23
[58] Field of Search ..... 244/3.23; 102/498, 529

[56] References Cited

U.S. PATENT DOCUMENTS

| | | | |
|---|---|---|---|
| 3,800,706 | 4/1974 | Gawlick et al. | 244/3.23 |
| 4,362,107 | 12/1982 | Romer et al. | 102/529 |
| 4,520,972 | 6/1985 | Diesinger et al. | 102/529 |

OTHER PUBLICATIONS

"Mechanical Vibrations" by J. P. Den Hartog (1934) pp. 166–173.

"Vibration Problems in Engineering" by S. Timoshenko, pp. 338 & 339.

*Primary Examiner*—Deborah L. Kyle
*Assistant Examiner*—Michael J. Carone
*Attorney, Agent, or Firm*—Lowe, Price, LeBlanc, Becker & Shur

[57] ABSTRACT

Disclosed is a training projectile having the same ballistic characteristic as the operational projectile. The training projectile comprises on elongated body having a L/D ratio of substantially 10–25. Fins are attached to the projectile and are configured to cause a change in rate of spin of the projectile from its initial rate to a rate which is coincident with a critical rate of spin to cause structural failure of the projectile at a predetermined range in flight.

21 Claims, 11 Drawing Figures

TYPICAL VARIATION OF FIN ANGLE FOR CRITICAL WHIRL SPEED

FAILURE SPIN RATES FOR TUNGSTEN ALLOY RODS

SELF-DESTRUCTING PROJECTILE

BACKGROUND OF THE INVENTION

The present invention relates to high velocity fin stabilized armor piercing projectiles and more particularly relates to projectiles of such type which are self-destructing.

Armor piercing projectiles can be generally divided into two main classes: armor piercing projectiles characterized by a relatively low length-to-diameter (L/D) ratio such as 3–5 which are fired by a gun or cannon with a rifled bore which provides gyroscopic stability during the trajectory; and armor piercing projectiles having a relatively high L/D ratio such as 10–25 either fired by a gun or rocket propelled wherein stability during the trajectory is obtained by the use of stabilizer fins.

The invention concerns the latter class wherein spin at slow rates is used to stabilize the projectile. To accomplish this fins are designed to produce a rotation about the longitudinal centerline at a rate somewhat above the natural aerodynamic pitching frequency of the particular projectile. This prevents erratic flight paths and permits good prediction of accuracies.

Use of high velocity APFSDS projectiles for defeat of armor is widespread due to the high performance capability of this type projectile. Production ammunition is now in use for gun sizes from 25 mm to at least 120 mm. However these projectiles, with their very high ratio of mass-to-frontal area and high muzzle velocities have the capability when fired of going long distances (measured in tens of miles) if they do not impact some target or terrain. This introduces considerable concern in tactical training since few test or training ranges are sufficiently large to contain such high energy projectiles over distances as extensive as may be required.

As a result an urgent need has developed for some effective means of providing a range limiting feature for such projectiles. Methods that have been used include explosive destruct and air drag increases caused by choked flow variations through orifices in conical afterbody configurations. However these methods suffer certain limitations and disadvantages from the standpoints of reliability, ballistic simulation, or ability to limit range. As a result a more effective means of limiting the range for training projectiles is still highly desired.

SUMMARY OF THE INVENTION

It is an object of the present invention to provide a high velocity fin stabilized armor piercing projectile having predetermined self-destructing characteristics.

It is a further object of the invention to provide a high velocity fin stabilized armor piercing projectile which is practical for use in training rounds where close duplication of the operational projectile flight characteristics are desired over the initial phase of trajectory but then abrupt loss of speed is desired to prevent the projectile from continuing in flight beyond practical range limitations.

It is another object of the invention to provide a high velocity armor piercing fin stabilized projectile which is constructed to fail at a predetermined point, time or range in its use.

It is another object of the invention to provide a high velocity fin stabilized armor piercing projectile which is constructed to fail at a given point, time or range in its use by achieving a spin rate substantially in coincidence with a critical frequency or whirl speed of the device.

It is still another object of the invention to provide an improved high velocity fin stabilized armor piercing projectile in which the shape and/or alignment of the fins with respect to the centerline of the projectile is used to generate a spin rate which changes from the initial spin rate imparted during firing to a value at or close to a critical spin speed in order to cause bending failure, instability or rupture.

It is another object of the invention to provide a projectile of the foregoing type which is suitable for firing from a gun or cannon tube or to launching by rocket propulsion.

It is another object of the invention to provide an improved high velocity fin stabilized armor piercing projectile of a self-destructing type wherein failure and/or destruct occurs either through increasing or decreasing the spin rate to reach a critical whirl frequency through canting of the fins to cause failure.

It is another object of the invention to provide a projectile comprising an elongated body having fin means attached thereto wherein such fin means are configured to cause a change in rate of spin of the projectile from its initial rate to a rate which is substantially in coincidence with a critical rate of spin to cause failure of said projectile at a substantially predetermined range of flight.

It is another object of the invention to provide a training projectile having the same ballistic characteristics as the operational projectile wherein the training projectile comprises an elongated body having an L/D ratio of substantially 10–25 and having attached fin means wherein such fin means are configured to cause a change in rate of spin of said projectile from its initial rate to a rate which is substantially in coincidence with a critical rate of spin to cause failure of said projectile through bending instability at a substantially predetermined range of flight.

These and other objects of the invention will become more apparent from reference to the following specification, drawings and claims.

BRIEF DESCRIPTION OF THE DRAWINGS

Referring to FIG. 1 there is shown a three piece projectile 10 comprising a body or penetrator 12, wind screen 14 and fin assembly 16. Fins 18 are carried by the fin assembly at a cant angle indicated at a.

Figure 1:
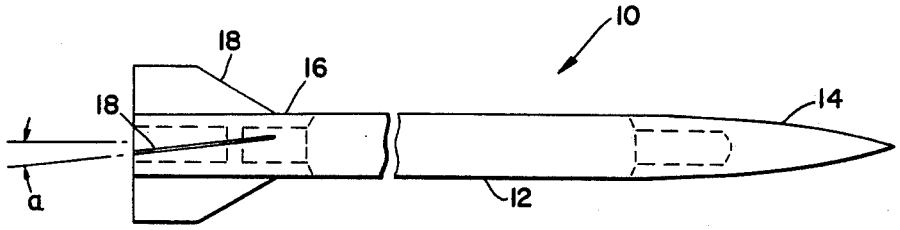
FIG. 1 is a side elevation of a high velocity fin stabilized armor piercing projectile constructed in accordance with one embodiment of the invention.

According to the present invention it has been discovered that it is possible to configure high velocity fin stabilized armor piercing projectiles by canting the fins with respect to the centerline of the projectile so that the spin rate generated by the canted fins will cause a desired predetermined structural failure of the projectile by achieving a critical whirl speed. As presently will be described in further detail it has been found that for a projectile of a given L/D ratio the critical whirl speed for bending failure is determined by the length of the equivalent rod. Changes in material affect the critical speed by the square root of the ratio of the modulus of elasticity to the material density. For geometrically similar projectiles, the fin angle required to develop a spin rate sufficient for failure at a given velocity is dependent only on the L/D ratio of the projectile. Again, material changes will have the same affect as stated. Ballistic coefficients for the projectiles remain unchanged when the fin angles are altered. Thus the trajectory of the self-destructing round remains the same as the basic projectile.

In order to illustrate the invention, representative projectiles are described for analysis. These consist of a 105 mm APFSDS-T penetrator identified as A, and a family of penetrators based on a 25 mm APFSDS-T identified as B. In the case of the family three geometry changes are presented. These consist of the penetrator B as designed, a version geometrically scaled 4/1 in size, and a version scaled 4/1 in size and extended from the original L/D ratio of 12 to an L/D ratio of 20. Characteristics of these illustrative projectiles are presented in FIGS. 3 and 4 and in the following table.

PROJECTILE CHARACTERISTICS

| ITEM | A | Basic B | 4/1 B | 4/1 L/D = 20 B |
|---|---|---|---|---|
| Penetrator L/D | 17.7 | 12 | 12 | 20 |
| Body dia., ins. | 0.947 | 0.327 | 1.308 | 1.308 |
| Penetrator length, ins. | 16.8 | 3.92 | 15.68 | 26.16 |
| Penetrator weight, lbs. | 8.05 | 0.224 | 12.35 | 20.58 |
| Total projectile weight, lbs. | 8.60 | 0.236 | 13.12 | 22.00 |
| Frontal area, sq. ins. | 0.704 | 0.084 | 1.344 | 1.344 |
| Fin area (ea), sq.ins. | 1.934 | 0.180 | 2.884 | 2.884 |
| Penetrator density lbs/cu in. | 0.68 | 0.61 | 0.61 | 0.61 |
| Modulus of elastisicy, psi | 24e+6 | 50e+6 | 50e+6 | 50e+6 |
| Radius to fin M.A.C., ins. | 0.859 | 0.246 | 0.984 | 0.984 |
| Number of fins | 6 | 4 | 4 | 4 |
| I (cross-sect.), in.$^4$ | 3.95e−2 | 5.61e−4 | 1.44e−1 | 1.44e−1 |
| I (mass), lb-in.$^2$ | 9.64e−1 | 2.83e−3 | 2.806 | 4.705 |
| Muzzle velocity, ft/sec. | 4,900 | 4,600 | 4,600 | 4,600 |
| Drag coefficient, Cd | 0.48 | 0.35 | 0.35 | 0.35 |
| Ballistic coefficient | 25.4 | 7.21 | 27.9 | 46.8 |
| Range constant, ft. | 95,700 | 27,100 | 105,000 | 176,000 |
| Time constant, sec. | 1.62 | 0.0531 | 2.06 | 3.45 |
| Fin lift curve slope | 0.08 | 0.10 | 0.10 | 0.10 |

The table includes the parameter called "time constant" which is the time for the rotational speed to reach 63% of the design value. Also included is the parameter called "range constant" which is the theoretical time for a projectile to decay in speed to 37% of its original velocity.

The self-destruct projectiles of the invention are designed and constructed according to equations developed as hereinafter set forth. These equations are solved using the parameters of the illustrative projectiles to compute the downrange velocities and spin rates of such projectiles.

According to the invention approximate fin angles are selected to produce the desired rotational failure rates (spin rates) to cause failure at the desired range. Since the projectile is usually slowing down continuously as it proceeds downrange the angle must be above what would be selected for failure at the muzzle velocity. In addition, since the spin rate will be increasing slowly during the latter part of the flight (depending on the time constant), an additional increase in the design angle is desirable. Accordingly, the first selected cant angle of the fins should be on the order of 1.5 to 2.0 times the angle calculated from the equations hereinafter set forth based on the muzzle velocity. Response curves for the representative projectiles are shown in FIGS. 5–8.

Figure 4:
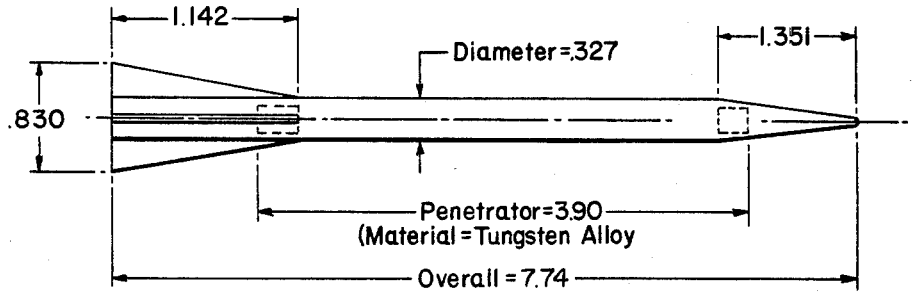
FIG. 4 is a side elevation of a four fin embodiment of a typical high velocity fin stabilized armor piercing projectile illustrating certain dimensions.
Figure 5:
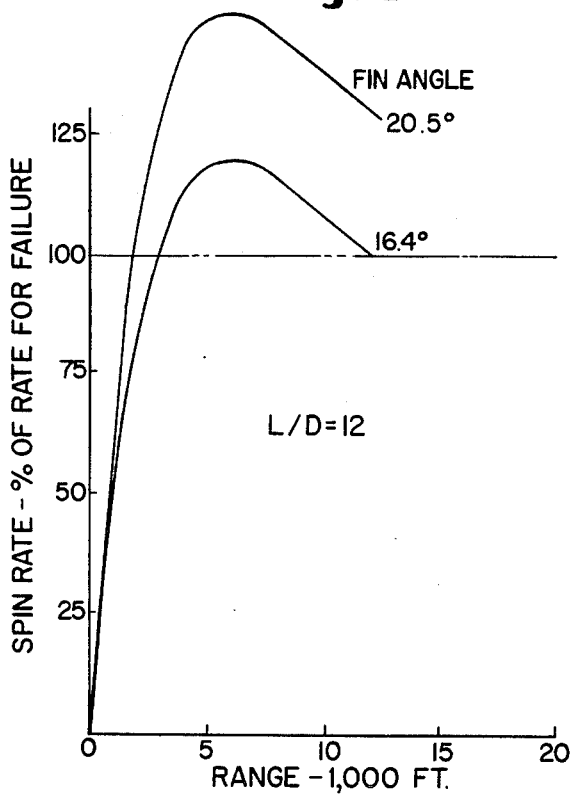
FIGS. 5–8 are response curves for a series of projectiles constructed according to the invention.

FIG. 5 relates to the basic projectile B which is illustrated in FIG. 4 and detailed in the above table. This penetrator, less than four inches in length, is representative of the smaller anti-armor projectiles. The curves of FIG. 5 show that for fin angles of 16°–20° the spin rate for failure is reached by the time the projectile has gone approximately 3,000 feet (less than 1000 meters). Accordingly the use of this destruct technique for these projectiles is limited to possible use when self-destruction in the range of 3,000–5,000 feet is acceptable.

Figure 6:
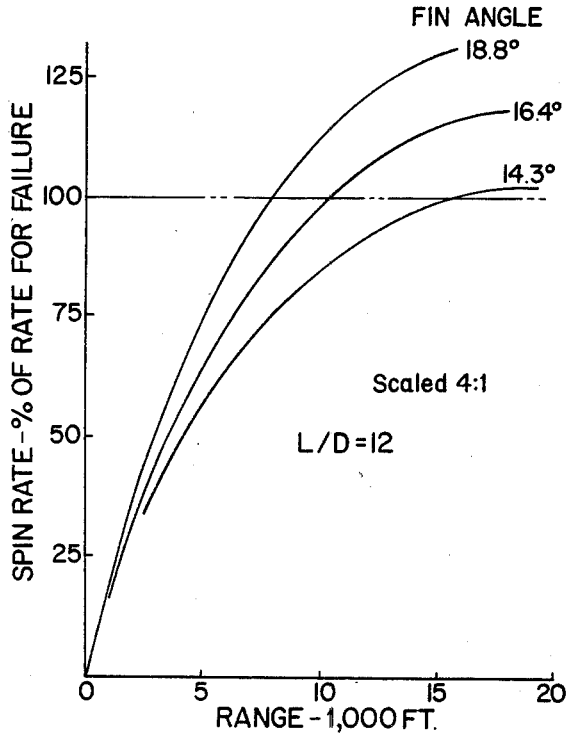

FIG. 6 relates to the projectile B scaled up to 4/1 in size. This figure shows the effects of three different cant angles on a projectile representative of typical tank anti-armor ammunition. It can be seen that an angle can be selected such that self-destruction occurs at some range above 11,000 feet, which achieves the desired effect of limiting the range of the projectile during training exercises.

Figure 7:
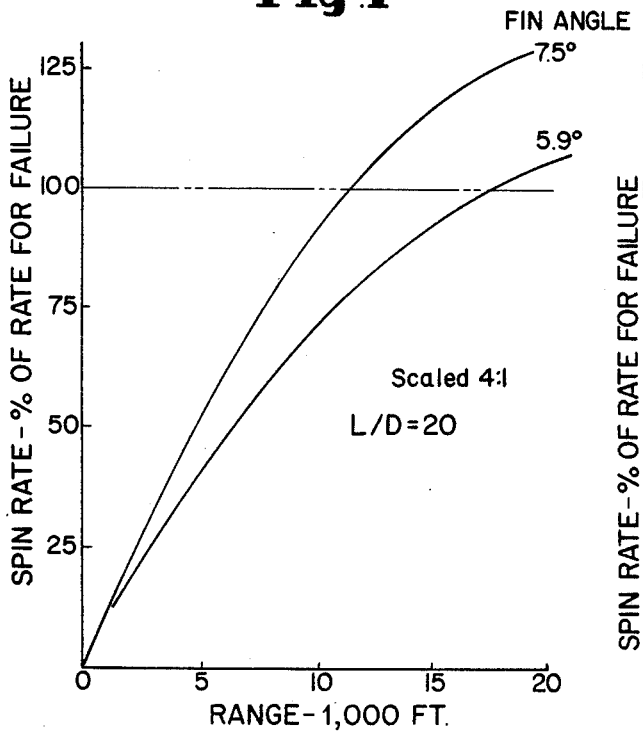

FIG. 7 relates to the projectile B scaled up to 4/1 in size and extended to a L/D ratio of 20 as indicated in the above table. These curves illustrate the comparative results when a typical projectile is extended in length to a higher L/D ratio. It can be seen that it is possible to control the self-destruct range to the same approximate area as was selected for the lower L/D projectile merely by revision of the fin cant angle.

Figure 3:
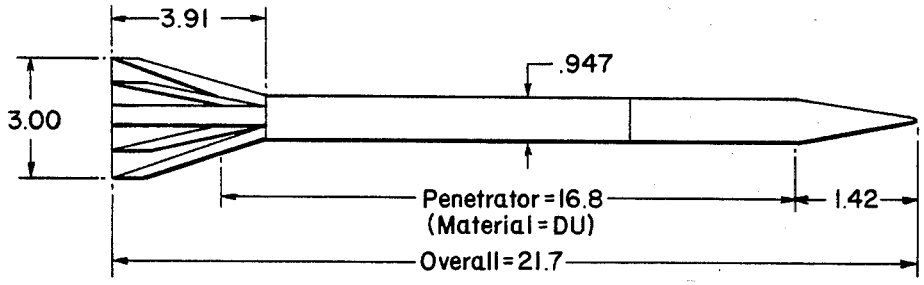
FIG. 3 is a side elevation of a six fin embodiment of a typical high velocity fin stabilized armor piercing projectile illustrating certain dimensions.
Figure 8:
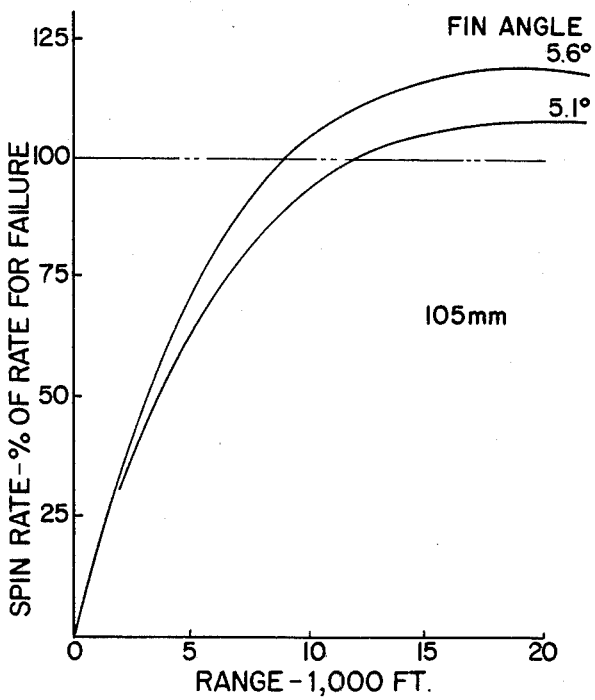

FIG. 8 relates to the projectile A which is illustrated in FIG. 3 and detailed in the above table. As shown in this figure self-destruction for this projectile can be obtained at ranges in excess of 10,000 feet by using fin cant angles of 5°–6°.

The equations used in the design of projectiles according to the invention may be developed as follows:

The critical whirl speed of a cylindrical shaft or rod in the free unsupported mode as derived by Den Hartog in "Mechanical Vibrations", (McGraw-Hill, 1934) is:

$$\omega = \frac{22.6}{l^2}\sqrt{\frac{EI}{\mu}} \text{ radians/sec} \quad (1)$$

where l=Rod length, ins

E=Modulus of elasticity, lbs/sq in

I=Cross section moment of inertia in$^4$ $\mu$=Mass per unit length, lbs/cu in

Making the substitutions of:

$$I = \frac{\pi d^4}{64} \text{ where } d \text{ is the dia., ins.}$$

$$\mu = \frac{\pi \rho_m d^2}{4g} \text{ where } \rho \text{ is the density of the material, lbs/cu in.}$$

Then $$\dot{\omega} = 5.65\frac{d}{l^2}\sqrt{\frac{Eg}{\rho_m}} \text{ rad/sec} \quad (2)$$

or $$f = 0.899\frac{d}{l^2}\sqrt{\frac{Eg}{\rho_m}} \text{ rev/sec} \quad (3)$$

Figure 9:
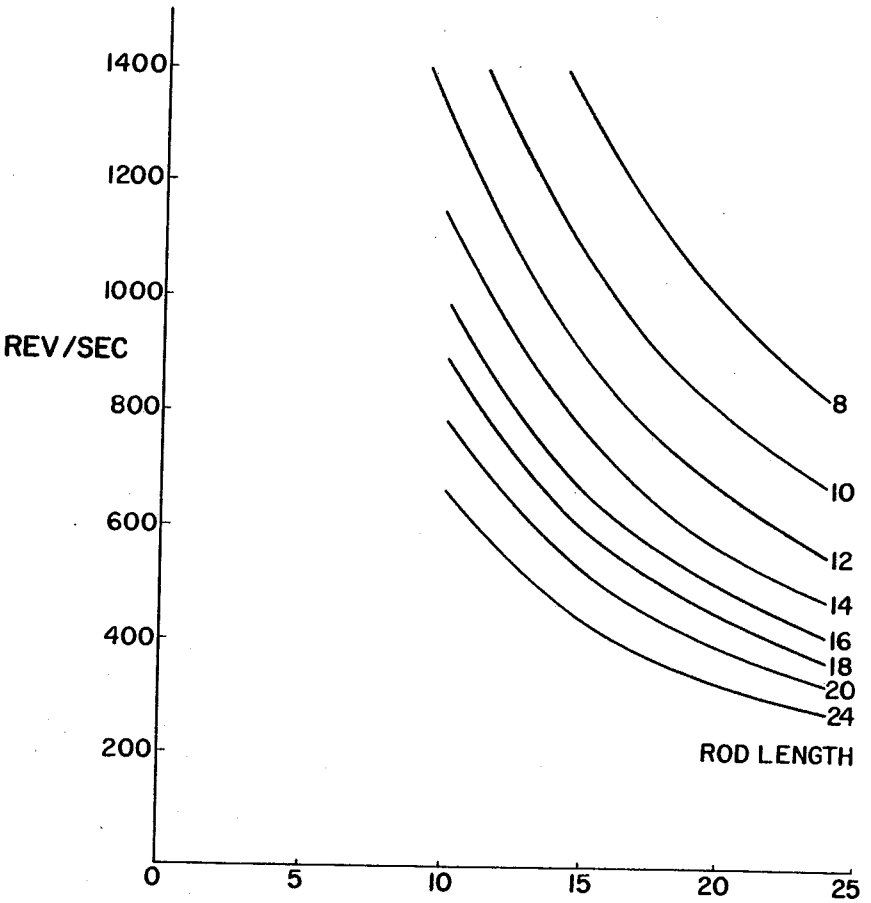
FIG. 9 is a family of curves illustrating the interrelationship of projectile geometry to spin rates required to produce whirl failure.

The above equation, plotted in FIG. 9 for 96% tungsten alloy (typical for many KE projectiles) having E=50,000,000 psi and $\rho$=0.68 lbs/cu in, shows the range of critical rotational speeds for a family of such penetrators. It will be seen that for a given L/D of the penetrator, the critical speed is only a function of the rod length. For a steel penetrator the critical speeds would change by ratios of the square roots of the density and modulus changes. This would amount to an increase of about 17% in the critical speed.

According to the invention critical speed may be generated pursuant to the following considerations. KE projectiles typically are fired at high velocity using a sabot with an obturator designed to reduce the effects of the rifling present in the gun barrel. A small fin dissymmetry or slight taper on one side of each fin is used to make sure that a slow rotation (a few revolutions per second) is maintained to average out aerodynamic and dynamic misalignments in the projectile. It can be seen from FIG. 9 that considerably higher spin rates are required to produce a whirl failure. These rates can be produced by providing an angle of attack of each fin with respect to the projectile centerline (or by using helical fins with the proper helix lead angle).

If the fins are provided with an angle, such as generated by a helix, then the spin rate will eventually reach a steady state value of:

$$\text{Tan } \alpha_0 = \frac{\omega r_f}{V} \quad (4)$$

where $\alpha_o$=angle of fin with respect to the projectile centerline

V=velocity of projectile, ft/sec $r_f$=radius from projectile centerline to fin M.A.C., ft substituting 4 into equation 3 and using $r_f = k_f d$ we obtain:

$$\text{Tan } \alpha_o = \frac{k_f}{V}\left(\frac{d}{l}\right)^2\sqrt{\frac{Eg}{\rho_m}} \quad (5)$$

Figure 10:
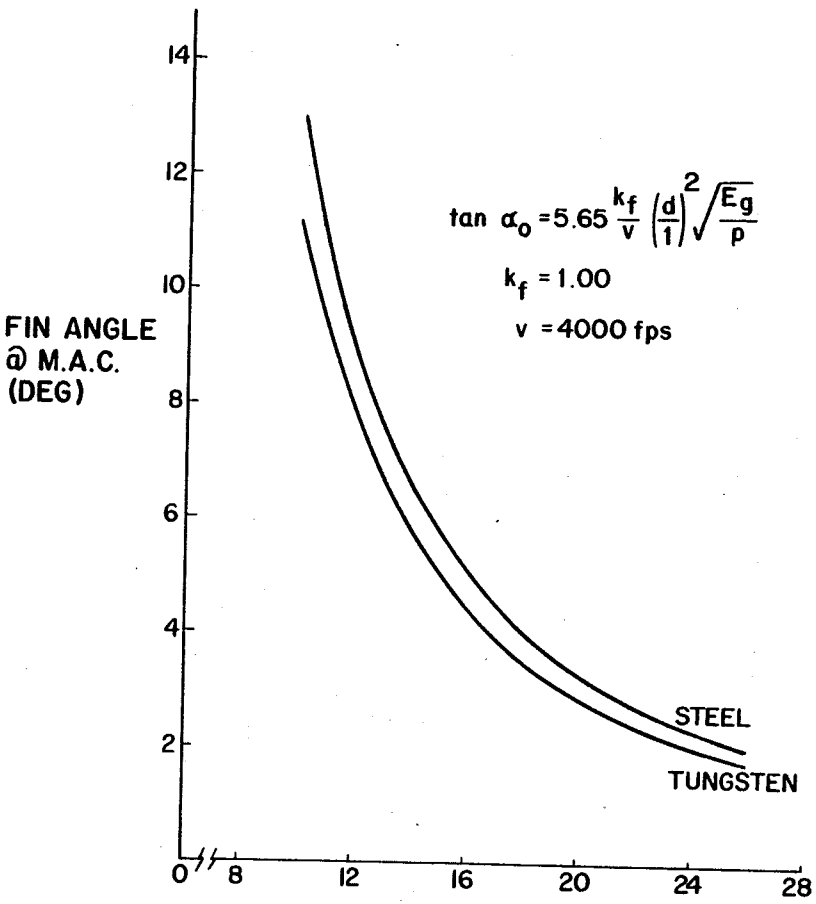
FIG. 10 is a pair of curves illustrating the interrelationship of L/D ratio of the projectile to the fin angle necessary to produce whirl failure for different projectile materials.

Thus, for geometrically similar projectiles the average or effective fin angle is determined solely by the penetrator material characteristics and the L/D ratio. FIG. 10 shows typical fin angles required for tungsten and steel alloy penetrators with $k_f$=1.0 for a typical velocity of 4,000 fps.

The projectile exits from the gun barrel at low rotational speeds. For purposes of this descriptional analysis the initial rotational speed is assumed to be zero. Thus as soon as the sabot is discarded, the fins with an angle $\alpha_o$ with respect to the projectile centerline will be at the same angle of attack with respect to the airstream. As the projectile starts to rotate, the angle of attack at any given instant will be:

$$\alpha = \alpha_0 - \frac{\omega r_f}{V} \quad (6)$$

The torque on the projectile, generated by n number of fins will be (assuming the velocity to be constant):

$$T = \alpha n\, k_f d\, A\frac{\rho_a}{2}V^2\left(\frac{d\,C_L}{d\alpha}\right) \quad (7)$$

$$= k_1 V^2 \alpha \text{ where } k_1 = n\, k_f d\, A\frac{\rho a}{2}\left(\frac{d\,C_L}{d\alpha}\right) \quad (8)$$

$$= K_1 V^2\left(\alpha_o - k_f d\frac{\omega}{V}\right) = I\frac{d\omega}{dt} \quad (9)$$

and

A=frontal area of projectile

The solution to this equation is:

$$\frac{\alpha}{\alpha_0} = e^{-\frac{K1 k_f d}{V}t} \quad (10)$$

Or, in terms of rotational speed:

$$\omega = \frac{\alpha_o V}{k_f d}(1 - e^{-t/T}) \text{ where } 1/T = K_1\frac{k_f d V}{I} \quad (11)$$

If the initial rotational speed is not=o, then the equation becomes:

$$\omega = \omega_f - (\omega_f - \omega_o)\left(1 - e^{\frac{t}{T}}\right) \quad (12)$$

The above equations may also be written as:

$$\frac{\omega}{\omega_f} = 1 - e^{-t/T} \quad (11a)$$

-continued and $$\frac{\omega}{\omega_f} = 1 - \left(1 - \frac{\omega_o}{\omega_f}\right) e^{-\frac{t}{T}} \tag{12a}$$

where $\omega_f$= "final" rotational speed

Rotational speed as a function of range may be calculated as follows. High velocity anti-tank projectiles are fired at velocities from 3500 to 5,000 fps in flat trajectories. Effective range is limited not by velocity drop-off, but by aiming and other ballistic errors which reduce the hit probabilities to unacceptably low levels beyond ranges of about 4,000 meters (13,000 feet). Within this range, projectiles having high ballistic coefficients ($m/C_DA$) will loose little velocity and the downrange velocities and time-of-flights can be developed from:

$$m\frac{dV}{dt} = -C_D\frac{\rho_a}{2} A V^2 \tag{13}$$

The above equation can be written as:

$$mV\frac{dV}{dx} = -C_D\frac{\rho_a}{2} A V^2 \tag{14}$$

The solution of the above equation results in the following equations:

Downrange velocity, V $$\frac{V_X}{V_O} = e^{\frac{C_D\rho_a A}{2m} x} \tag{15a}$$

$$= e^{-x/L} \tag{15b}$$

$$\text{where } L = \frac{2m}{C_D\rho_a A}$$

$$= \text{Range Constant}$$

Time to reach velocity, $$t_{vx} = \frac{L}{V_O}\left(\frac{V_O}{V_x}\right) - 1 \tag{16}$$

Time to reach range x, $$t_x = \frac{L}{V_O}(e^{x/L-1}) \tag{17}$$

The last three equations can be used to compute flight characteristics with high accuracy over the effective combat range of APFSDS projectiles. In addition, equation 15 can be used for obtaining the drag coefficient of projectiles when radar velocity measurements are made at downrange positions. If the ratio V/Vo is plotted versus range on semi-log paper, the line connecting the points will be a straight line with the slope of $-1/L$ and the line will intercept V/Vo=0.63 at the "Range Constant" L. With projectile mass, air density, and frontal area known, the drag coefficient is then obtained directly.

Combining equations 11a and 17, the expression for the rotational speed versus range is then:

$$\frac{\omega}{\omega_f} = 1 - e^{-\frac{L}{V_O T}\left(e^{\frac{x}{L}} - 1\right)} \tag{18}$$

Also, for $\omega \neq O$:

$$\frac{\omega}{\omega_f} = 1 - \left(1 - \frac{\omega_o}{\omega_f}\right) e^{-\frac{L}{V_O T}\left(e^{\frac{X}{L}} - 1\right)} \tag{18a}$$

Above expression 18 does not constitute an exact solution for the rotational speed since the velocity has been assumed to remain constant over the flight time involved. A precise analysis may be obtained by step analysis over the trajectory but a close approximation may be obtained by multiplying the above expression by the ratio V/Vo. If such approximation is made, then the error over the ranges of intrest is less than 4% as determined by comparative computations. Thus, the easiest correction is made by the following:

$$\frac{\omega}{\omega_f} \text{ Corrected} = \frac{V}{V_o}\left(\frac{\omega}{\omega_f}\right) \tag{19}$$

The above correction was used to calculate the results shown in FIGS. 5–8.

The use of spin-induced whirl failure of APFSDS type projectiles has a number of advantages which can result in appreciable cost savings when used for training purposes. The first advantage is ease of manufacture. Use of the technique requires only the substitution of a different set of fins from the standard production fin. In the case of penetrators fabricated from DU material, a substitution of tungsten alloy is possible at considerable cost savings. No additional parts such as separation devices, explosive components, fuses, or expensive machined parts are required. In general, the fin assembly can be extruded through a helical die, thereby minimizing the fabrication cost of the fins. A second advantage of the invention is in reliability. The elimination of all extra parts and components as described above provides an inherent improvement in reliability. In addition reliance on a proven dynamic principle results in a high probability of uniform functioning.

A still further advantage lies in the ballistic similarity of the projectiles. Since the same projectile with essentially no change in mass properties, geometry or drag characteristics is used the ballistic characteristics of time-of-flight, gravity drop and dispersion remain basically unchanged. This allows realistic crew training with no alteration to the combat firing tables set into the fire control computer.

Generally speaking the use of canted fins to cause high spin rates to induce whirl structural instability and subsequent failure is limited to L/D ratios generally in excess of 10. For very large L/D ratios (in excess of 25) difficulty may be encountered in that required spin rates may be quite low with the result that accurate machining or forging of the fins for small angles introduces production problems. Accordingly the invention is intended for use with elongated projectiles having an L/D ratio generally in the range of 10–25.

The preceding description has been in terms of a penetrator body of rod form. Failure of a shaft or rod from whirl instability occurs in the bending mode. Since the kinetic energy caused by the rotation of the projectile increases much faster than does the potential energy of bending, failure can occur rapidly when the rotational speed is increasing quickly. However, if highly ductile materials are used then plastic bending will occur above the yield stress of the material, causing permanent deformation but no fracture. With lower ductility materials a fracture and separation of the rod into at least two parts will occur. The fracture will occur close to the midpoint where the bending moments are highest.

If the cross section of the penetrator is not constant but is grooved as is the case with most APFSDS projectiles, then the grooves will act as stress raisers and accelerate fracture. Since the tensile and compressive stresses near the middle of the rod are low during launch, it is a feature of the invention that a deeper groove may be machined in the middle of the projectile to further promote fracture. Such a projectile is shown in FIG. 2.

Figure 2:
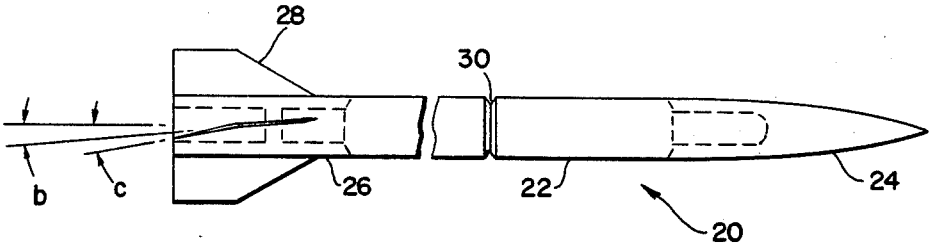
FIG. 2 is a side elevation of a high velocity fin stabilized armor piercing projectile constructed according to another embodiment of the invention.

Referring to FIG. 2 there is shown a projectile 20 comprising a body or penetrator 22, windscreen 24 and fin assembly 26. Fins 28 are carried by the fin assembly. In this embodiment of the invention the fins 28 comprise helically twisted fins having an angle b at their base and an angle c at their tip. Typically the angle b may be 5°–10° and the angle c may be 8°–12°. The projectile is provided at its midsection with a stress raising groove 30.

It is desirable that a training projectile have the same ballistic characteristics as the operational projectile. For this reason it is best to use the same diameter, general fin configuration, nose shape and total weight. By so doing the ballistic coefficient and the range constant are unchanged and if no changes are made that alter the drag coefficient then the flight characteristics will be duplicated.

Thus the first choice is to use the identical projectile design with suitable alterations to cant the fins to the desired angle for the necessary spin rate. This may result in the projectile destructing at too short a range, a satisfactory range or an excessively long range. In the event the range is too short, the main body may be increased in diameter so that the time constant is increased. Similarly, the material densities may be varied. If the range is too long, then the L/D of the main body may be increased (if practical) and possibly the material density lowered, to achieve a close ballistic match while achieving destruction at a suitable range.

Figure 11:
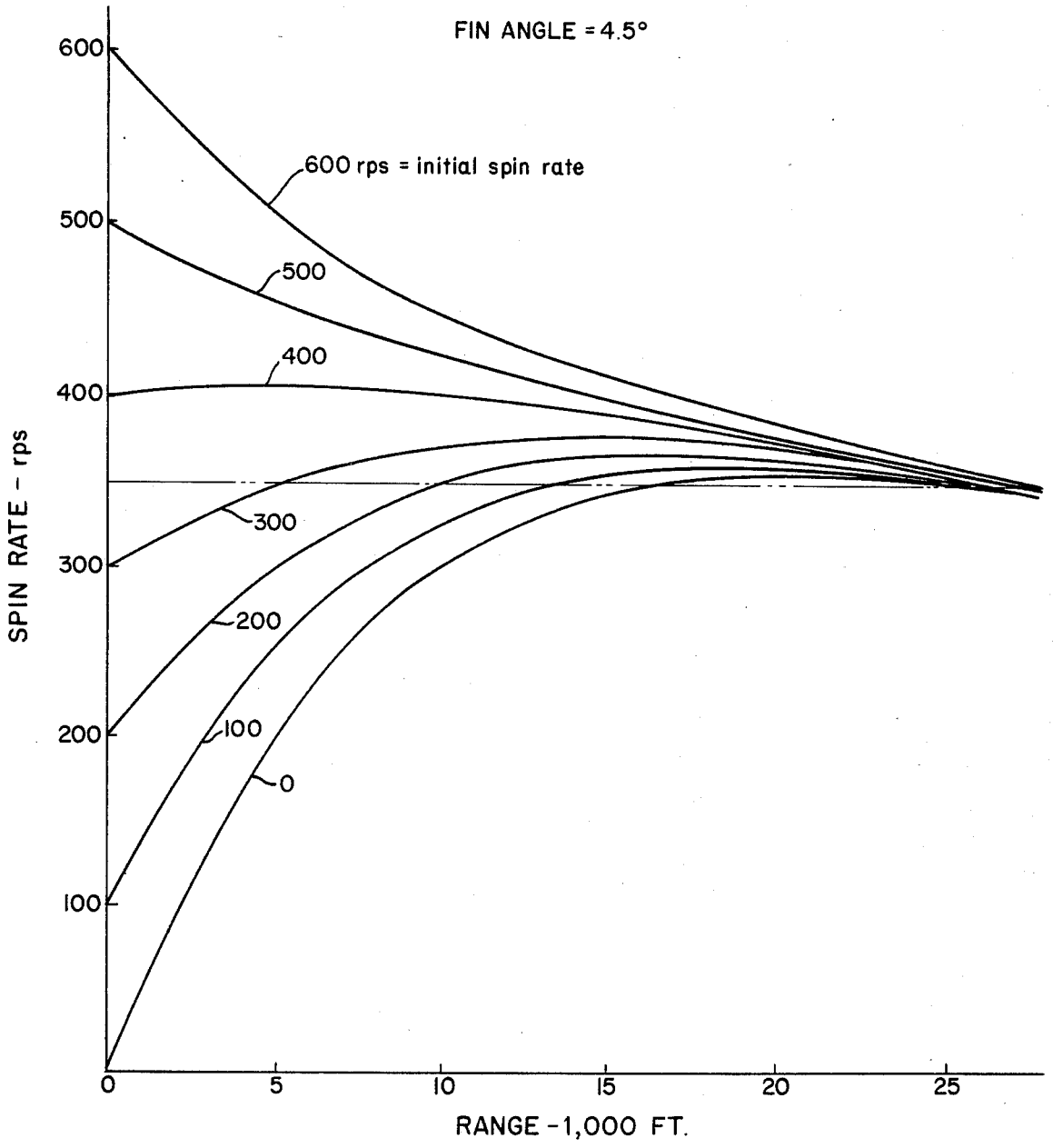
FIG. 11 shows a family of curves illustrating use of the invention to provide predetermined projectile self-destruction with either increasing or decreasing spin rates.

While the discussion heretofore has been generally in terms of a projectile constructed according to the invention undergoing an increase in whirl or spin rate to reach the critical spin rate to self-destruct, it is to be understood that the invention comprehends use with projectiles which may have an initial spin rate in excess of the critical spin rate. Such high spin rates can be achieved by way of example by use of sabots which are close fitting in the gun tube so that exit spin rates approach the gun tube rifling twist. For a 1/20 twist at a muzzle velocity of 4925 FPS this rate can reach over 700 RPS. FIG. 11 illustrates the effect of initial spin rate on a projectile having a fin angle of 4.5°. Reference to that figure shows that self-destruct for decreasing spin rate projectiles of this configuration would occur at ranges of approximately 25,000 feet. Variations in the self-destruct range may be secured by modification of the fin angle and other parameters described hereinabove.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be enbraced therein.

I claim:

1. A fin stabilized projectile comprising an elongated body having fin means attached thereto wherein such fin means are configured to effect a rate of spin of such projectile which is substantially in coincidence with a critical whirl speed to cause predetermined structural failure by physical deformation of such projectile in flight.

2. A fin stabilized projectile comprising an elongated body having fin means attached thereto wherein said fin means are configured to generate a rate of spin of said projectile which is substantially in coincidence with a critical whirl speed to cause predetermined structural failure of said projectile in flight.

3. A fin stabilized projectile comprising an elongated body having fin means attached thereto wherein said fin means are configured to cause a change in the rate of spin of said projectile from its initial rate to a rate which is substantially in coincidence with a critical whirl speed to cause predetermined structural failure of said projectile in flight.

4. A fin stabilized projectile comprising an elongated body having fin means attached thereto wherein said fin means are configured to cause a change in rate of spin of said projectile from its initial rate to a rate which is substantially in coincidence with a critical whirl speed to cause structural failure of said projectile at a substantially predetermined range of flight.

5. A projectile according to claim 4 wherein said fin means is configured to increase the rate of spin of said projectile from its initial rate to said critical rate.

6. A projectile according to claim 4 wherein said fin means are configured to decrease the rate of spin of said projectile from its initial rate to said critical rate.

7. A projectile according to claim 4 wherein said fin means comprise fins which are canted with respect to the centerline of the projectile to generate said spin rate.

8. A projectile according to claim 4 wherein said fin means comprise helically twisted fins.

9. A projectile according to claim 4 wherein said projectile is adapted to be fired from a gun.

10. A projectile according to claim 4 in which said projectile is adapted to be launched by rocket propulsion.

11. A projectile according to claim 4 wherein said projectile has a L/D ratio of substantially 10 to 25.

12. A projectile according to claim 4 wherein said failure occurs through bending instability.

13. A projectile according to claim 4 wherein said elongated body has a groove substantially at mid-length thereof.

14. A fin stabilized projectile comprising an elongated body having an L/D ratio of substantially 10–25 having fin means attached thereto wherein said fin means are configured to cause a change in rate of spin of said projectile from its initial rate to a rate which is substantially in coincidence with a critical rate of spin to cause failure of said projectile through bending instability at a substantially predetermined range of flight.

15. A projectile according to claim 14 wherein said fin means is configured to increase the rate of spin of said projectile from its initial rate to said critical rate.

16. A projectile according to claim 14 wherein said fin means are configured to decrease the rate of spin of said projectile from its initial rate to said critical rate.

17. A projectile according to claim 14 wherein said fin means comprise fins which are canted with respect to the centerline of the projectile to generate said spin rate.

18. A projectile according to claim 14 wherein said fin means comprise helically twisted fins.

19. A projectile according to claim 14 wherein said projectile is adapted to be fired from a gun.

20. A projectile according to claim 14 in which said projectile is adapted to be launched by rocket propulsion.

21. A projectile according to claim 14 in which said elongated body has a groove substantially at mid-length thereof.

* * * * *